US007706725B2

(12) United States Patent
Fujisawa et al.

(10) Patent No.: US 7,706,725 B2
(45) Date of Patent: Apr. 27, 2010

(54) FULL-COLOR IMAGE FORMING APPARATUS HAVING VARIABLE POWER LIGHT SOURCE

(75) Inventors: Toshiaki Fujisawa, Yamatokoriyama (JP); Shigeyuki Wakada, Nara (JP); Hitoshi Nagahama, Uji (JP)

(73) Assignee: Sharp Kabushiki Kaisha, Osaka (JP)

( * ) Notice: Subject to any disclaimer, the term of this patent is extended or adjusted under 35 U.S.C. 154(b) by 728 days.

(21) Appl. No.: 11/543,215

(22) Filed: Oct. 5, 2006

(65) Prior Publication Data

US 2007/0086808 A1 Apr. 19, 2007

(30) Foreign Application Priority Data

Oct. 5, 2005 (JP) ..... P2005-292692

(51) Int. Cl.
*G03G 15/01* (2006.01)

(52) U.S. Cl. ..... 399/178; 399/177; 399/179

(58) Field of Classification Search ..... 399/177, 399/178, 179

See application file for complete search history.

(56) References Cited

U.S. PATENT DOCUMENTS

| | | | |
|---|---|---|---|
| 5,436,647 | A | 7/1995 | Kasahara |
| 6,108,017 | A | 8/2000 | Katakura et al. |
| 2002/0051921 | A1 | 5/2002 | Morita et al. |
| 2003/0035042 | A1 | 2/2003 | Shimada et al. |
| 2004/0075758 | A1 | 4/2004 | Nomura et al. ..... 348/242 |
| 2006/0024597 | A1* | 2/2006 | Shoshi et al. ..... 399/159 |

FOREIGN PATENT DOCUMENTS

| | | |
|---|---|---|
| JP | 05-330130 | 12/1993 |
| JP | 05-336331 | 12/1993 |
| JP | 06-320800 | 11/1994 |
| JP | 11-24354 A | 1/1999 |
| JP | 11-295955 | 10/1999 |
| JP | 2000-242057 | 9/2000 |
| JP | 2000-280523 | 10/2000 |
| JP | 2001-330976 | 11/2001 |
| JP | 2002-072519 | 3/2002 |
| JP | 2003-341140 | 12/2002 |
| JP | 2003-266781 | 9/2003 |
| JP | 2005-78030 | 3/2005 |

* cited by examiner

*Primary Examiner*—David M Gray
*Assistant Examiner*—Ryan D Walsh
(74) *Attorney, Agent, or Firm*—Nixon & Vanderhye, PC

(57) ABSTRACT

In a full-color image forming apparatus including a light source for monochrome image formation that outputs light corresponding to monochrome image information and exposes a monochrome image forming photoreceptor and light sources for color image formation that output lights corresponding to color image information and expose photoreceptors for forming images of colors other than black, when the light source for monochrome image formation and the light sources for color image formation are caused to output the lights and a full-color image is formed, an optical output of the light source for monochrome image formation is set to become equal to or less than optical outputs of the light sources for color image formation, preferably, become less than the optical outputs of the light sources for color image formation.

15 Claims, 4 Drawing Sheets

FULL-COLOR IMAGE FORMING APPARATUS HAVING VARIABLE POWER LIGHT SOURCE

This application claims priority to Japanese Patent Application No. 2005-292692 filed on Oct. 5, 2005, the entire contents of which is hereby incorporated by reference.

BACKGROUND OF THE TECHNOLOGY

1. Field of the Technology

The present technology relates to a full-color image forming apparatus using an electrophotographic method.

2. Description of the Related Art

Although an image forming apparatus using an electrophotographic method which was at first developed was of a type capable of forming only a monochrome image (a black- and white image), there has been developed another type of image forming apparatus capable of forming a full-color image, namely, a full-color image forming apparatus with diversification of images expected to be formed, and which has been widely used.

However images to be formed by an image forming apparatus have diversified, it is the present condition that, even in a full-color image forming apparatus, the frequency of forming monochrome images is higher than the frequency of forming full-color images, and the frequency of forming monochrome images is about five times that of forming full-color images.

Therefore, in order to form a large amount of monochrome images in a full-color image forming apparatus, different proposals to increase the efficiency of monochrome image formation are offered. For example, in Japanese Unexamined Patent Publication JP-A 5-336331 (1993), it is proposed to conduct changeover of image formation speed between a full-color image formation mode and a monochrome image formation mode, and as well set the number of scanning lines of a laser beam in the monochrome image formation mode larger than the number of scanning lines of a laser beam in the full-color image formation mode.

Further, in Japanese Unexamined Patent Publication JP-A 2000-280523, it is proposed to set the number of light beams outputted from an optical scanner at the time of monochrome printing larger than the number of light beams outputted from the optical scanner at the time of color printing. Furthermore, in Japanese Unexamined Patent Publication JP-A 2003-266781, it is proposed to make an inscribed radius of a polygon mirror for monochrome image formation, which is more frequently used in printing, smaller than an inscribed radius of a polygon mirror for color, and also increase the number of mirror planes of the polygon mirror, thereby shortening a rise time before the polygon mirror for monochrome image formation starts rotating from the stop state.

The techniques disclosed in JP-A 5-336331, JP-A 2000-280523 and JP-A 2003-266781 are effective for enhancing the efficiency of monochrome image formation. However, as mentioned before, the frequency of monochrome image formation is about five times the frequency of color image formation. Therefore, unless lengths of life of apparatus members relating to monochrome image formation are at least five times those of the apparatus members relating to color image formation, a length of life of a full-color image forming apparatus is limited by monochrome image formation. That is to say, the length of life of the full-color image forming apparatus is limited by the apparatus member relating to monochrome image formation though the length of life of the apparatus member relating to color image formation is left, with the result that replacement or repair of the apparatus member is required. JP-A 5-336331, JP-A 2000-280523 or JP-A 2003-266781 does not disclose any technique relating to extension of the length of life of the apparatus member relating to monochrome image formation or the length of life of the full-color image forming apparatus. Besides, the technique disclosed in JP-A 2003-266781 has a problem that increase of the number of the mirror planes of the polygon mirror leads to increase in costs.

As an art for seeking extension of the length of life of the apparatus member relating to monochrome image formation, which is more frequently used in the full-color image forming apparatus, in Japanese Unexamined Patent Publication JP-A 2000-242057, it is proposed to make a diameter of a photoreceptor for monochrome image formation larger than a diameter of a photoreceptor for color, and in Japanese Unexamined Patent Publication JP-A 2001-330976, it is proposed to make film thickness of a photosensitive layer of the photoreceptor for monochrome image formation more than film thickness of a photosensitive layer of the photoreceptor for color.

According to JP-A 2000-242057 and JP-A 2001-330976, mainly the amount of shaving of a photosensitive layer is critical to the length of life of the photoreceptor. Therefore, by making the diameter of the photoreceptor larger, the frequency with which a circumferential surface of the photoreceptor is shaved by a cleaning blade or the like is decreased, with the result that the length of life is extended. Moreover, by thickening the photosensitive layer itself, the length of life of the photoreceptor is extended.

The apparatus member relating to monochrome image formation is not only the photoreceptor for monochrome image formation but also a light source for monochrome image formation for exposing the photoreceptor for monochrome image formation to light corresponding to monochrome image information. Since the light source for monochrome image formation is used with the same frequency as the photoreceptor for monochrome image formation at the time of monochrome image formation, the length of life thereof gradually decreases while being used as well as the length of life of the photoreceptor for monochrome image formation. Therefore, it is impossible to realize extension of the length of life of the full-color image forming apparatus only by seeking extension of the length of life of the photoreceptor for monochrome image formation, and it is necessary to extend the length of life of the light source for monochrome image formation used with the same frequency as the photoreceptor for monochrome image formation. However, JP-A 2000-242057 or JP-A 2001-330976 does not disclose any technique for seeking the length of life of the light source for monochrome image formation.

SUMMARY OF THE TECHNOLOGY

An object of the technology is to provide a full-color image forming apparatus that has a long length of life which is obtained by focusing on that the frequency of monochrome image formation is higher than the frequency of full-color image formation, by extending the length of life of apparatus members relating to monochrome image formation.

The technology provides a full-color image forming apparatus comprising a light source for monochrome image formation for exposing a monochrome image forming photoreceptor to light outputted therefrom to correspond to monochrome image information; and a light source for color image formation for exposing a color image forming photoreceptor to light outputted therefrom to correspond to color image information, wherein a full-color image is formed by exposing the monochrome image forming photoreceptor with the light source for monochrome image formation and the color image forming photoreceptor with the light source for color image formation, wherein also a monochrome image is formed by exposing only the monochrome image forming photoreceptor with the light source for monochrome image formation, and wherein when a full color image is formed using lights outputted from the light source for monochrome image formation and the light source for color image formation, an optical output from the light source for monochrome image formation is set to equal to or less than an optical output of the light source for color image formation.

According to the technology, the full-color image forming apparatus is capable of forming both a full-color image and a monochrome image and, when outputting lights from the light source for monochrome image formation and the light source for color image formation to form a full-color image, the optical output of the light source for monochrome image formation is set to become equal to or less than the optical output of the light source for color image formation. By setting the optical output of the light source for monochrome image formation at the time of full-color image formation to become equal to or less than the optical output of the light source for color image formation, deterioration of the light source for monochrome image formation is suppressed as compared with deterioration of the light source for color image formation, with the result that extension of a length of life of the light source for monochrome image formation is realized. Since it is possible to apply an extended part of the length of life of the light source for monochrome image formation to monochrome image formation, it is possible to provide a full-color image forming apparatus whose length of life is not limited by formation of a monochrome image and whose total length of life is long though the frequency of monochrome image formation is higher than the frequency of full-color image formation.

Further, in the technology, it is preferable that the full-color image forming apparatus comprises:

determining means for determining whether an image to be formed is a full-color image or a monochrome image; and controlling means for, when the determining means determines that the image to be formed is a full-color image, controlling in accordance with the determination so that the optical output of the light source for monochrome image formation becomes equal to or less than the optical output of the light source for color image formation.

According to the technology, the full-color image forming apparatus is configured comprising determining means for determining whether an image to be formed is a full-color image or a monochrome image, and controlling means for, when the determining means determines that the image to be formed is a full-color image, controlling in accordance with the determination so that the optical output of the light source for monochrome image formation becomes equal to or less than the optical output of the light source for color image formation. This configuration makes it possible to easily realize a setting such that the optical output of the light source for monochrome image formation at the time of full-color image formation becomes equal to or less than the optical output of the light source for color image formation.

Furthermore, in the technology, it is preferable that:

the monochrome image forming photoreceptor and the color image forming photoreceptor have cylindrical or columnar shapes; and a perimeter of the monochrome image forming photoreceptor is longer than a perimeter of the color image forming photoreceptor.

According to the technology, the monochrome image forming photoreceptor and the color image forming photoreceptor have cylindrical or columnar shapes, and the monochrome image forming photoreceptor is formed so that a perimeter thereof is longer than a perimeter of the color image forming photoreceptor. Consequently, a length of life of the monochrome image forming photoreceptor is extended, with the result that, along with the extension of the length of life of the light source for monochrome image formation, it is possible to realize extension of the length of life of the full-color image forming apparatus without being affected by monochrome image formation even in the case where the frequency of monochrome image formation is higher than the frequency of color image formation.

Still further, in the technology, it is preferable that sensitivity of the monochrome image forming photoreceptor to light is higher than sensitivity of the color image forming photoreceptor to light.

According to the technology, the monochrome image forming photoreceptor is formed so as to have higher sensitivity to light than that of the color image forming photoreceptor. Consequently, at the time of full-color image formation, even when the optical output from the light source for monochrome image formation is equal to or less than the optical output from the light source for color image formation, the monochrome image forming photoreceptor can exhibit the same charge characteristics and potential attenuation characteristics by exposure as the color image forming photoreceptor.

In the technology, it is preferable that the light source for monochrome image formation and the light source for color image formation are laser diodes.

According to the technology, laser diodes are used as the light source for monochrome image formation and the light source for color image formation, with the result that it is possible to provide a full-color image forming apparatus in which the light sources are compact in size and a large-output exposing portion is provided.

BRIEF DESCRIPTION OF THE DRAWINGS

Other and further objects, features, and advantages of the technology will be more explicit from the following detailed description taken with reference to the drawings wherein.

DETAILED DESCRIPTION

Figure 1:
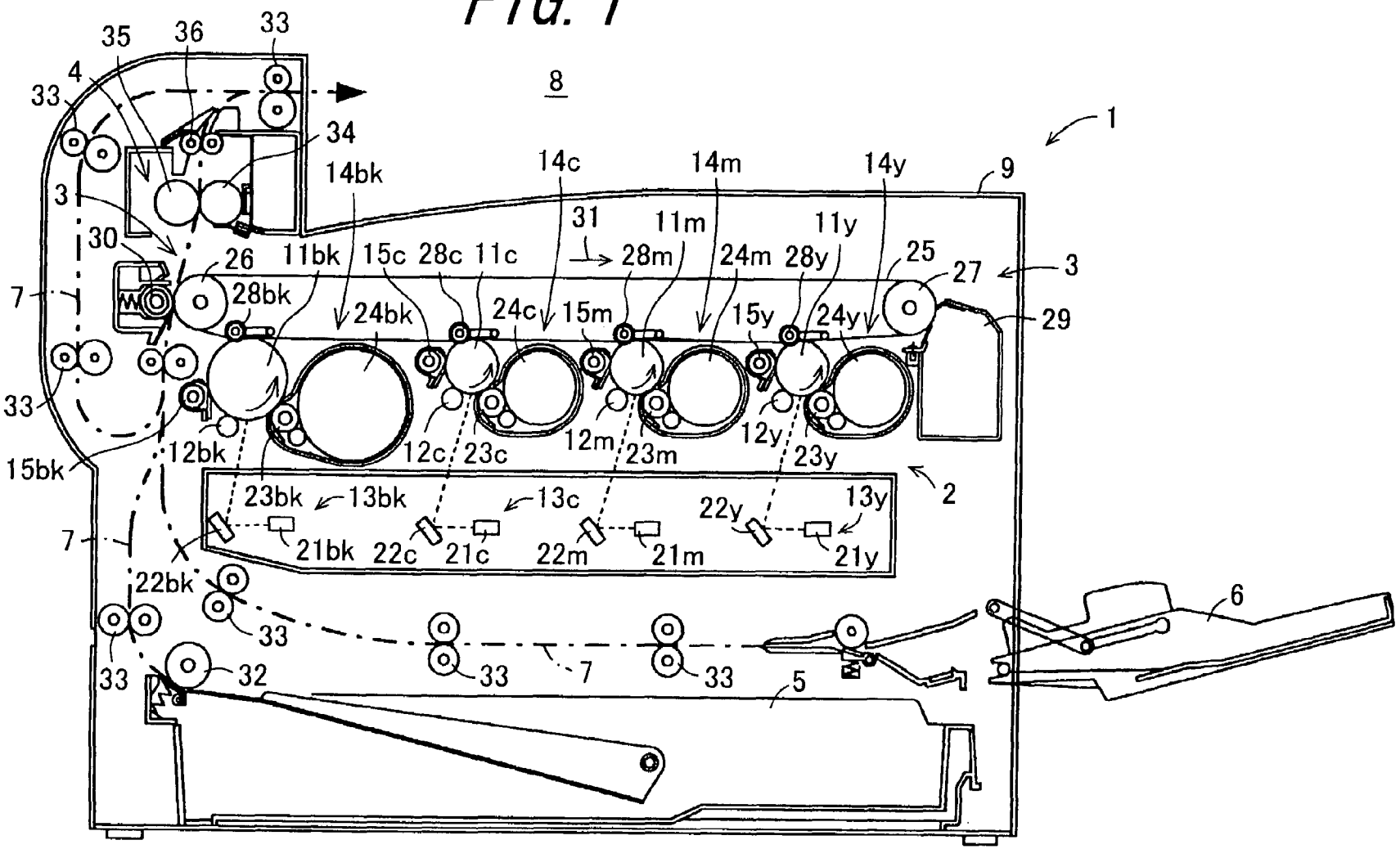
FIG. 1 is a side cross section view illustrating a simplified configuration of a full-color image forming apparatus according to an embodiment of the technology.

Now referring to the drawings, preferred embodiments of the technology are described below.

FIG. 1 is a side cross section view illustrating a simplified configuration of a full-color image forming apparatus 1 according to an embodiment of the technology. The full-color image forming apparatus 1 is, for example, an electrophotographic full-color printer that is connected to an external device such as a personal computer creating image information, an external device such as a scanner reading image information from an image document and so on, and that is capable of forming both a full-color image and a monochrome image that is a monochrome image on a recording medium such as a recording sheet in accordance with the obtained image information. The full-color image forming apparatus 1 is not limited to a printer, and may be a full-color copier equipped with an image reading portion, and may be a multifunction printer provided with a copier function and a printer function and also a facsimile function.

In brief, the full-color image forming apparatus 1 comprises an image forming portion 2, a transfer portion 3, a fixing portion 4, an automatic sheet feeding portion 5, a manual-bypass sheet feeding portion 6, a sheet conveying portion 7, a sheet discharge portion 8, and a casing 9 in which the respective portions described above are held or attached.

The image forming portion 2 forms a visible image based on the image information inputted from the external device and subjected to image processing in an image processing portion that is not illustrated in the drawing. The image forming portion 2 includes a photoreceptor 11, a charger 12, an exposing portion 13, a developing portion 14 and a cleaning portion 15. The full-color image forming apparatus 1 is capable of forming a full-color image, and the image information corresponds to a color image using each of colors of black (bk), cyan (c), magenta (m) and yellow (y). Therefore, the photoreceptor 11, the charger 12, the exposing portion 13, the developing portion 14, the cleaning portion 15, and a transfer roller 28 included in the transfer portion 3 are provided so as to correspond to each of the colors, respectively. Here, the respective portions provided so as to correspond to the respective colors will be distinguished by adding the alphabetical letters representing the respective colors to the ends of the reference numerals. In the case of generically naming, the respective portions will be denoted by only the reference numerals.

The photoreceptor 11 is: a layered-type photoreceptor of a separated function type in which a photosensitive layer is formed by laminating a charge generating layer and a charge transporting layer on a circumferential surface of a conductive substrate having a cylindrical shape made of aluminum alloy or the like; a layered-type photoreceptor of a three-layered structure provided with a photoreceptor surface protection layer; a single-layer photoreceptor in which functions of the charge generating layer and the charge transporting layer are provided in a single layer; or a photoreceptor of an inorganic substance typified by amorphous silicon. In a uniformly charged condition by the charger 12, the photoreceptor is exposed to light corresponding to image information by the exposing portion 13, whereby an electrostatic latent image is formed. The charger 12 is not specifically limited as far as it is means for charging the photoreceptor. For example, a charger of a roller type, a fur brush type, a magnetic brush type, a corona wire type, a saw-toothed type or an ionizer type is used.

Figure 2:
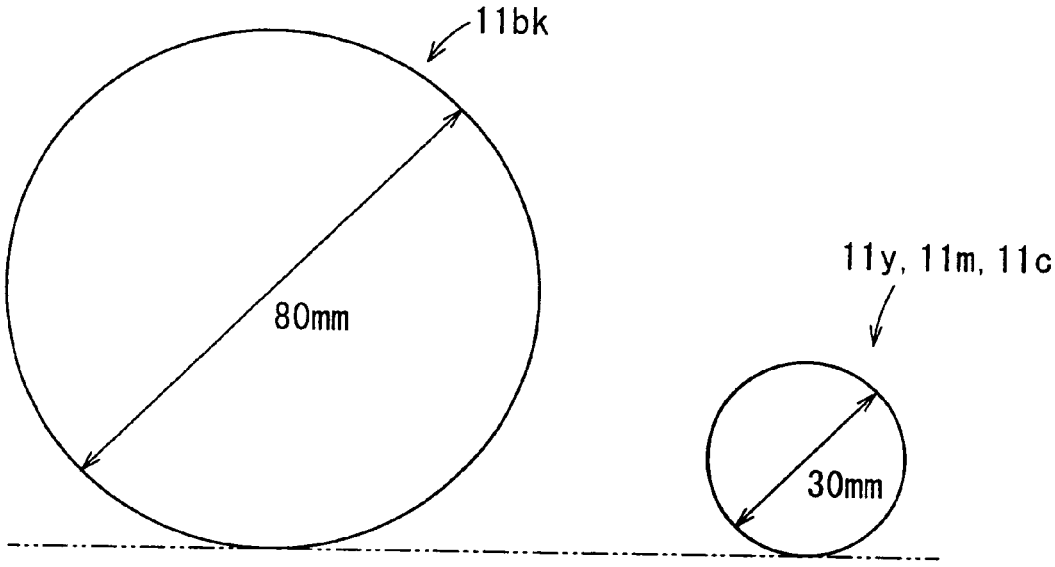
FIG. 2 is a view illustrating a comparison of perimeters of photoreceptors.

The full-color image forming apparatus 1 is characterized in that a perimeter of the photoreceptor 11*bk* for forming a monochrome image is longer than perimeters of the photoreceptors 11*y*, 11*m* and 11*c* for forming color images. By configuring so that the perimeter of the monochrome image forming photoreceptor 11*bk* becomes longer than the perimeters of the color image forming photoreceptors 11*y*, 11*m* and 11*c*, a length of life of the monochrome image forming photoreceptor 11*bk* is extended. From the perspective of the extension of the length of life of the monochrome image forming photoreceptor 11*bk*, the longer the perimeter becomes, the lower the frequency with which a circumferential surface of the photoreceptor 11*bk* is rubbed by the cleaning portion 15 becomes, with the result that the amount of film shaving of the photosensitive layer is decreased, and the length of life is extended. However, since elongation of the perimeter is against the request for downsizing the full-color image forming apparatus 1 as a whole, the upper limit of the elongation of the perimeter is properly determined in consideration of a balance between the degree of request for the extension of the length of life and dimensions of the apparatus on design of the apparatus. Taking up a specific set perimeter in the present embodiment as one example, the perimeter of the monochrome image forming photoreceptor 11*bk* is 80 πmm (an outer diameter: 80 mm), and each of the perimeters of the color image forming photoreceptors 11*y*, 11*m* and 11*c* is 30 πmm (an outer diameter: 30 mm) as illustrated in FIG. 2.

Figure 3:
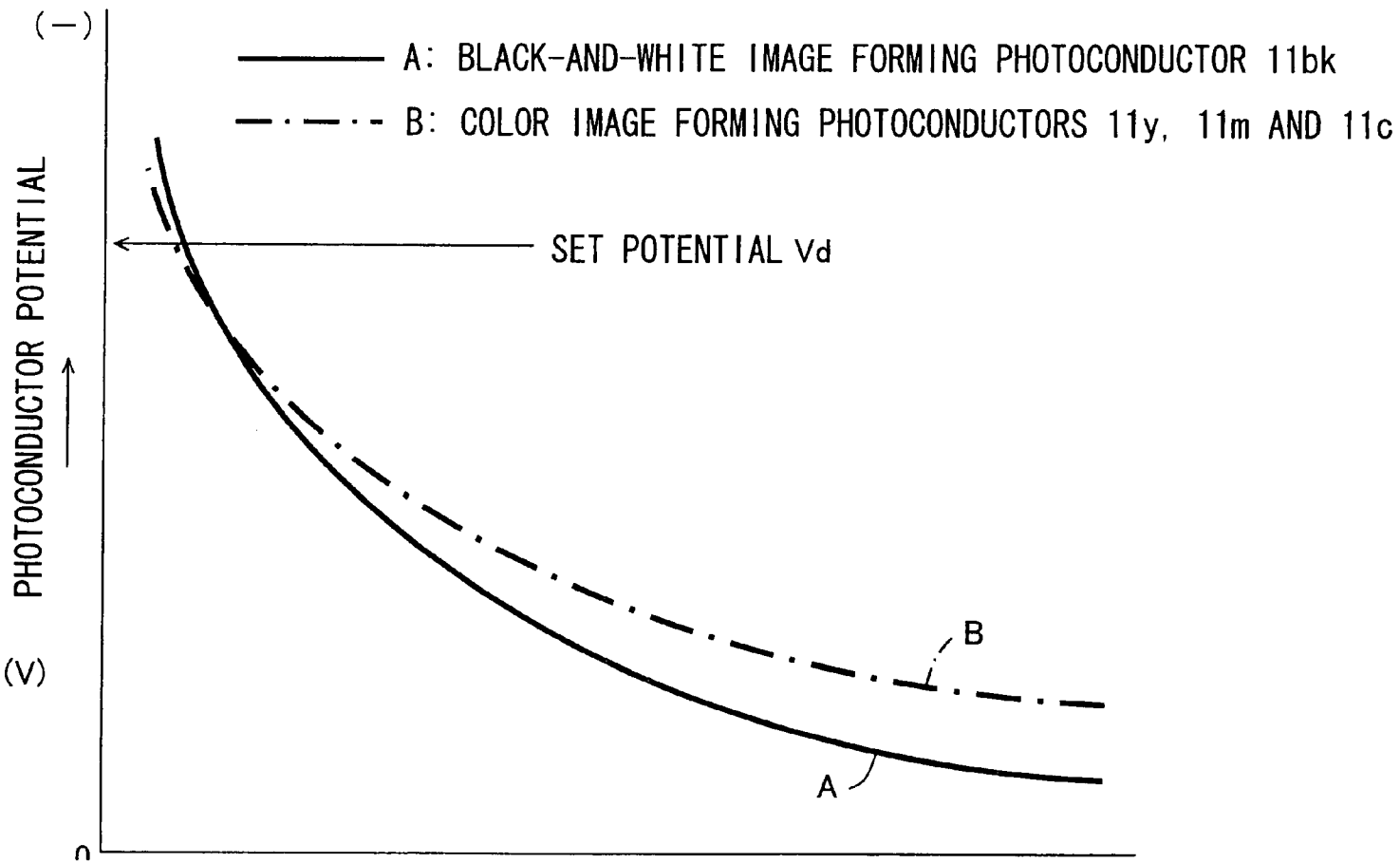
FIG. 3 is a view illustrating a comparison of sensitivities of the photoreceptors.

Further, the full-color image forming apparatus 1 is characterized in that sensitivity of the monochrome image forming photoreceptor 11*bk* to light is higher than sensitivities of the color image forming photoreceptors 11*y*, 11*m* and 11*c* to light. FIG. 3 is a view qualitatively illustrating a comparison of the sensitivities of the photoreceptors 11. In FIG. 3, the sensitivities of the photoreceptors are qualitatively illustrated with an amount of laser exposure for exposing the photoreceptor as the abscissa and photoreceptor potential of the negative photoreceptor as the ordinate. Since the photoreceptors illustrated in FIG. 3 are negative photoreceptors, an increase on the ordinate means an increase of negative potential. However, the photoreceptors may be positive photoreceptors and, in the case of using positive photoreceptors, charge polarity of toner, polarity of a charging device in the image forming apparatus and so on are set to become appropriate as the occasion demands. In FIG. 3, a line A represents sensitivity characteristics of the monochrome image forming photoreceptor 11*bk*, and a line B represents sensitivity characteristics of the color image forming photoreceptors 11*y*, 11*m* and 11*c*. Comparing the monochrome image forming photoreceptor 11*bk* represented by the line A of FIG. 3 with the color image forming photoreceptors 11*y*, 11*m* and 11*c*, the photoreceptor potential of the photoreceptor 11*bk* is lower at the same laser exposure amount in a region where the laser exposure amount on the abscissa is small, and an attenuation (cancel) amount of the photoreceptor potential with respect to a unit exposure change (increase) thereof is larger. In this specification, such characteristics of the photoreceptor is referred as "the sensitivity thereof is higher".

By making the sensitivity of the monochrome image forming photoreceptor 11*bk* to light higher than the sensitivities of the color image forming photoreceptors 11*y*, 11*m* and 11*c* to light as described above, the monochrome image forming photoreceptor 11*bk* can exhibit the same charge characteristics as those of the color image forming photoreceptors 11*y*, 11*m* and 11*c* even when an optical output of a light source 21*bk* for monochrome image formation is set to become equal to or less than optical outputs of light sources 21*y*, 21*m* and 21*c* for color at the time of full-color image formation, as described in detail later.

In general, however, when the sensitivity of a photoreceptor is increased, dark decay occurs more easily, which is a phenomenon that the potential is attenuated before development is executed by a developing portion after the photoreceptor is uniformly charged by a charger and exposed by an exposing portion. Therefore, it is desirable that the increase of the sensitivity of the monochrome image forming photoreceptor 11*bk* is limited within a range that decrease of image density due to dark decay does not occur.

Regarding the layered-type photoreceptor, it is possible to realize increase of the sensitivity of the monochrome image forming photoreceptor 11*bk* by methods such as: (a) using a charge generating substance having high quantum efficiency; (b) increasing density of a charge generating substance in the charge generating layer; and (c) decreasing film thickness of the charge generating layer in order to make electrons run faster toward a board because a speed of the electrons is considerably slower than a speed of holes moving toward the charge transporting layer.

One of the methods for decreasing the film thickness of the charge generating layer is, in a case where the charge generating layer is applied by dip coating as disclosed in Japanese Unexamined Patent Publication JP-A 2002-72519, use of a coating fluid for forming the charge generating layer including a charge generating substance, a binding resin, an organic solvent and silicone oil whose surface tension is 22 mN/m or less. By making the charge generating layer coating fluid include the silicone oil, dispersiveness, stability and coating properties of the coating fluid increase, with the result that it is possible to apply and form a charge generating layer having thin film thickness without inconsistencies in coating and film thickness.

Referring to FIG. 1 again, the charger 12, the developing portion 14, the transfer roller 28 and the cleaning portion 15 are placed in this order toward a downstream side in the rotation direction of the photoreceptor 11 around the photoreceptor 11. The exposing portion 13 is placed so that light of image information of each of the colors emitted from the exposing portion 13 is applied on a surface of the photoreceptor 11 through between the charger 12 and the developing portion 14. The charger 12 is charging means for uniformly charging the surface of the photoreceptor 11 to designated potential, and the charger used in the present embodiment is a roller type.

The exposing portion 13 exposes the surface of the photoreceptor 11 charged to uniform potential by the charger 12, in accordance with image information of each of the colors, thereby forming an electrostatic latent image on the surface. The exposing portion 13 for each of the colors includes the light source 21, and a reflection mirror 22 such as a polygon mirror that reflects light emitted from the light source 21 and guides to the surface of the photoreceptor 11. That is to say, the light source for monochrome image formation 21*bk*, and light sources for color image formation including the yellow light source 21*y*, the magenta light source 21*m* and the cyan light source 21*c* are provided as the light sources 21. In the present embodiment, laser diodes (LDs) are used as the respective light sources 21. The light sources 21 are not limited to LDs, and may be light emitting diodes (LEDs) arranged into an array, combination of another light source and a liquid crystal shutter, and so on.

The full-color image forming apparatus 1 is capable of forming a full-color image by exposing the monochrome image forming photoreceptor 11*bk* with the light source for monochrome image formation 21*bk* and exposing the color image forming photoreceptors 11*y*, 11*m* and 11*c* with the light sources for color image formation 21*y*, 21*m* and 21*c*, and also capable of forming a monochrome image by exposing only the monochrome image forming photoreceptor 11*bk* with the light source for monochrome image formation 21*bk*. When outputting lights from the light source for monochrome image formation 21*bk* and the light sources for color image formation 21*y*, 21*m* and 21*c* to form a full-color image, the full-color image forming apparatus sets the optical output of the light source for monochrome image formation 21*bk* to become equal to or less than the optical outputs of the light sources for color image formation 21*y*, 21*m* and 21*c*. A method for controlling the optical outputs will be described later.

The developing portion 14 develops the electrostatic latent image formed on the surface of the photoreceptor 11 by supplying toner of each of the colors, thereby forming a toner image as a visible image. The developing portion 14 includes a developing roller 23 that is disposed so as to face the photoreceptor 11 and supplies the toner to the photoreceptor 11, and a toner cartridge 24 that supplies the toner to the developing roller 23. In the full-color image forming apparatus 1, the frequency of monochrome image formation is higher than the frequency of full-color image formation, and the amount of consumed black toner is more than the amount of consumed color toners. Therefore, the black toner cartridge 24*bk* provided in the developing portion 14 is formed so that a capacity thereof becomes larger than capacities of the color toner cartridges 24*y*, 24*m* and 24*c*.

The cleaning portion 15 has a blade member disposed so as to abut on the circumferential surface of the photoreceptor 11, and makes the blade member slidingly contact the surface of the photoreceptor 11, thereby eliminating and collecting toner remaining without being transferred from the surface of the photoreceptor 11 to the transfer belt 25 of the transfer portion 3, from the surface of the photoreceptor 11.

The transfer portion 3 is placed above the photoreceptor 11, and configured including the transfer belt 25, a transfer belt driving roller 26, a transfer belt driven roller 27, transfer rollers 28*bk*, 28*c*, 28*m* and 28*y*, a transfer belt cleaning portion 29 and a recording sheet transfer roller 30. The transfer belt 25 is stretched on the transfer belt driving roller 26, the transfer belt driven roller 27 and the transfer rollers 28, and the transfer belt 25 is rotationally driven in a direction of arrow 31 by rotary driving of the transfer belt driving roller 26.

In the image forming portion 2, the photoreceptors 11 are placed, from an upstream side to a downstream side in the rotation direction of the transfer belt 25 illustrated with arrow 31, in the order of the yellow image forming photoreceptor 11*y*, the magenta image forming photoreceptor 11*m*, the cyan image forming photoreceptor 11*c* and the monochrome image forming photoreceptor 11*bk*. That is to say, the monochrome image forming photoreceptor 11*bk* is placed on the most downstream side in the rotation direction of the transfer belt 25.

The transfer belt 25 rotationally driven in the direction of arrow 31 is an intermediate transfer belt, and is disposed so as to contact the respective photoreceptors 11. When the transfer belt 25 passes by the photoreceptor 11 while contacting the photoreceptor 11, a transfer bias of opposite polarity to charge polarity of the toner on the surface of the photoreceptor 11 is applied from the transfer roller 28 placed so as to face the photoreceptor 11 via the transfer belt 25, and the toner image formed on the surface of the photoreceptor 11 is transferred on the transfer belt 25. In the case of full-color image formation, the toner images of the respective colors formed on the respective photoreceptors 11 are transferred on the transfer belt 25 one on top of the other in the order of yellow, magenta, cyan and black, whereby a full-color image is formed.

The transfer belt cleaning portion 29 is disposed so as to face the transfer belt driven roller 27 and contact a circumferential surface of the transfer belt 25 stretched on the transfer belt driven roller 27. Since the toner adhering to the transfer belt 25 through contact with the photoreceptors 11 causes contamination of a rear face of a recording medium, the transfer belt cleaning portion 29 eliminates the toner on the surface of the transfer belt 25.

Recording mediums such as recording sheets to record the toner images on are stored in the automatic sheet feeding portion 5. In the full-color image forming apparatus 1 of the present embodiment, the automatic sheet feeding portion 5 is disposed in a lower part of the apparatus. The recording sheets stored in the automatic sheet feeding portion 5 are taken out one by one from the automatic sheet feeding portion 5 by a pickup roller 32, and delivered to the sheet conveying portion 7. The recording sheet delivered to the sheet conveying portion 7 is conveyed by a plurality of conveying rollers 33 disposed at some places in the sheet conveying portion 7, and fed to a nip portion between the transfer belt driving roller 26 and the recording sheet transfer roller 30 disposed so as to face the transfer belt driving roller 26 and press the transfer belt driving roller 26, so as to be synchronism with a position to form the images transferred on the transfer belt 25 in the transfer portion 3. A transfer bias is applied from the recording sheet transfer roller 30 to the recording sheet passing through the nip portion, whereby the toner images are transferred all together on the recording sheet from the transfer belt 25. The recording sheet is not necessarily fed from the automatic sheet feeding portion 5, and may be fed through the other sheet conveying portion 7 from the manual-bypass sheet feeding portion 6.

The fixing portion 4 is disposed downstream in a conveying direction of the recording sheet from the transfer portion 3, and includes a heating roller 34, a pressurizing roller 35, a heating source for the heating roller 34, a sensor for detecting a temperature of the heating roller 34, a control portion for controlling an operation of the heating source so that the heating roller 34 is heated to a designated temperature, and so on. The heating roller 34 and the pressurizing roller 35 are disposed so as to be capable of holding and conveying the recording sheet while pressing each other. When the recording sheet passes through a nip portion formed by the heating roller 34 and the pressurizing roller 35, the fixing portion 4 fixes the toner image by heating and pressurizing, thereby forming a solid recording image. The recording sheet on which the toner image is fixed by the fixing portion 4 is discharged to the sheet discharge portion 8 by a sheet discharge roller 36 disposed on an exit side of the fixing portion 4 and the conveying roller 33.

As mentioned before, the full-color image forming apparatus 1 is capable of forming both a full-color image and a monochrome image, but the frequency and amount of monochrome image formation are more than those of full-color image formation. Therefore, in order to efficiently form a monochrome image, rotation circumferential velocities, namely, image formation processing speeds of the photoreceptor 11, a rotary drive system of the developing portion 14, a rotary drive system of the transfer portion 3 and a rotary drive system of the fixing portion 4 are set to become higher at the time of monochrome image formation than at the time of full-color image formation. The rotation circumferential velocity will be referred to as a process speed because it is a speed relating to an image formation process in the full-color image forming apparatus 1, and the respective drive systems will be integrally referred to as a process drive system.

Figure 4:
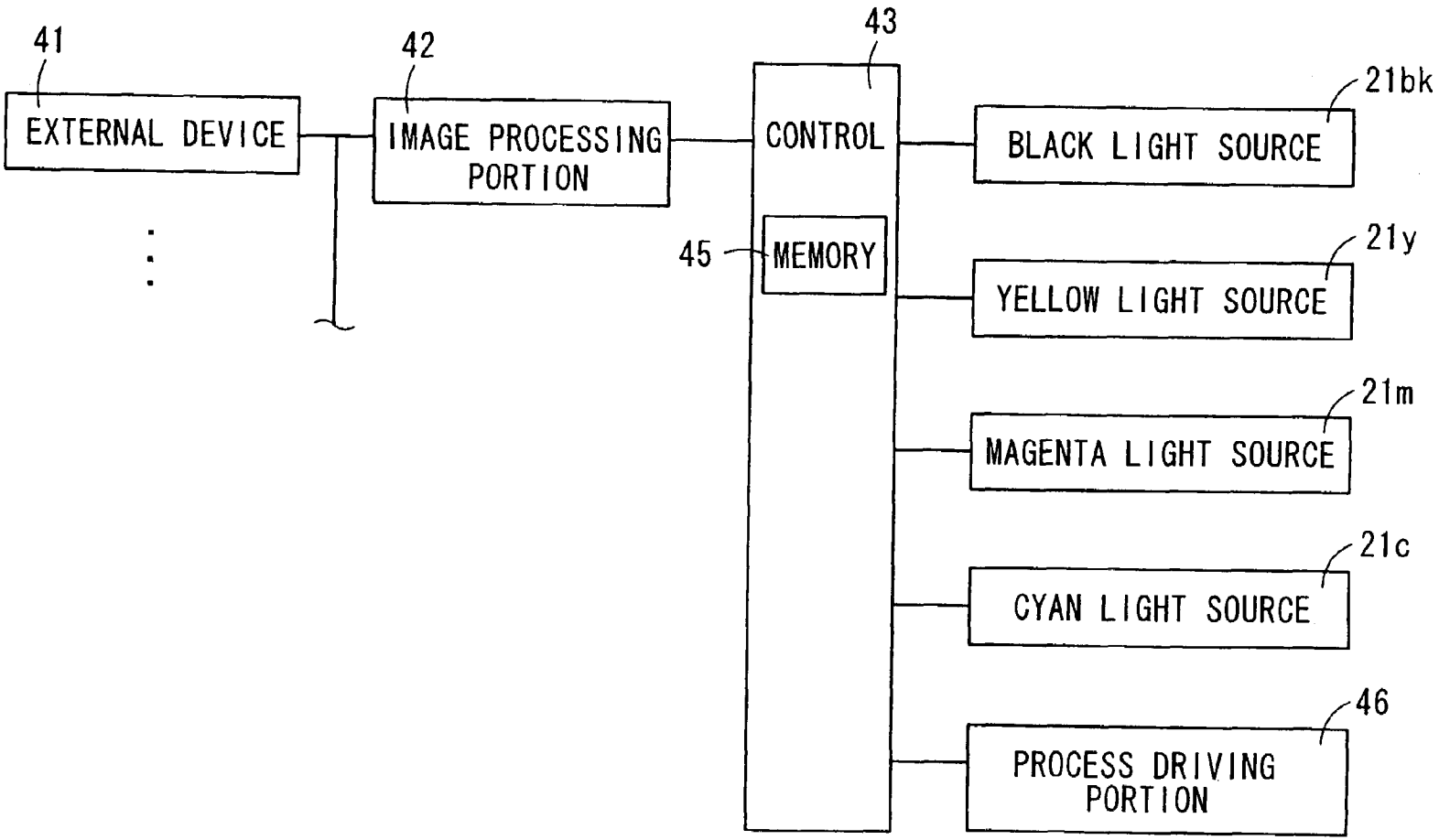
FIG. 4 is a block diagram illustrating an electrical configuration controlling the optical outputs of the light sources.

Next, control of the optical outputs of the respective light sources 21 at the time of full-color image formation and control of the optical output of the light source for monochrome image formation 21*bk* at the time of monochrome image formation will be described. FIG. 4 is a block diagram illustrating an electrical configuration controlling the optical outputs of the light sources 21.

The configuration relating to the control of the optical outputs in the full-color image forming apparatus 1 includes an image processing portion 42 that receives image information created and outputted by an external device 41 such as a personal computer and executes image processing such as tone processing; determining means for determining whether an image to be formed based on the image information processed by the image processing portion 42 is a full-color image or a monochrome image; and controlling means for, when the determining means determines that the image to be formed is a full-color image, controlling in accordance with the determination so that the optical output of the light source for monochrome image formation 21*bk* becomes equal to or less than the optical outputs of the light sources for color image formation 21*y*, 21*m* and 21*c*.

In the present embodiment, the determining means and the controlling means are formed as a single processing circuit, and realized by, for example, a microcomputer provided with a central processing unit (CPU). Here, the determining means and the controlling means will be collectively referred to as the control portion 43. A memory 45 serving as a storing portion is annexed to the control portion 43. As the memory 45, it is possible to use well-known storing means such as a hard disk drive (HDD), a read only memory (ROM) and a random access memory (RAM).

A program for carrying out a control of a whole operation of the full-color image forming apparatus 1 by the control portion 43, a standard for determining whether the image information taken into the image processing portion 42 is a monochrome image or a full-color image, a set value for controlling the optical outputs of the light sources 21 in accordance with the determination by the control portion 43, a set value for controlling the process speed of a process driving portion 46, and so on are stored in the memory 45 in advance. The standard for determining whether the image information taken into the image processing portion 42 is a monochrome image or a full-color image is as follows: it is determined that the image information is a monochrome image when information of any color other than black is not included at all; and it is determined that the image information is a full-color image when information of even one color other than black is included.

In the full-color image forming apparatus 1, in a case where the control portion 43 determines that the image to be formed based on the image information processed by the image processing portion 42 is a fill-color image, based on the determination, the control portion 43 controls operations of the respective light sources 21 so that the optical output of the light source for monochrome image formation 21*bk* becomes equal to or less than the optical outputs of the light sources for color image formation 21*y*, 21*m* and 21*c*, when outputting an operation command to cause the light source for monochrome image formation 21*bk* and the light sources for color image formation including the yellow light source 21*y*, the magenta light source 21*m* and the cyan light source 21*c* to output lights to form a full-color image. Moreover, at the time of full-color image formation, the control portion 43 controls an operation so that the process speed of the process driving portion 46 becomes slower than the process speed at the time of monochrome image formation.

In the full-color image forming apparatus 1 of the present embodiment, for example, the process speed (the circumferential velocity of the photoreceptor, for example) at the time of full-color image formation is 173 mm/sec, which is slower than a process speed of 355 mm/sec at the time of monochrome image formation, and the respective light sources 21 are controlled to operate so that the optical outputs thereof become as illustrated in Table 1. In this setting of the process speed and the optical outputs, a full-color image formation processing capability is about 40 sheets per minute in the case of A4 size paper prescribed by JIS-P0138.

TABLE 1

| Light source | Optical output (mW) |
|---|---|
| Yellow light source | 0.31 ± 0.03 |
| Magenta light source | 0.31 ± 0.03 |
| Cyan light source | 0.31 ± 0.03 |
| Light source for monochrome image formation | 0.28 ± 0.03 |

At the time of full-color image formation, the optical output of the light source for monochrome image formation 21*bk* is set to become equal to or less than the optical outputs of the light sources 21*y*, 21*m* and 21*c* for colors other than black, preferably, become less than the optical outputs of the light sources for color image formation 21*y*, 21*m* and 21*c*, whereby wear of the light source for monochrome image formation 21*bk* is suppressed as compared with wear of the light sources for color image formation 21*y*, 21*m* and 21*c* per unit time. Since the wear of the light source for monochrome image formation 21*bk* is suppressed at the time of full-color image formation, the length of life thereof is extended by a suppressed part of the wear. It is possible to apply an extended part of the length of life of the light source for monochrome image formation 21*bk* to monochrome image formation using only the light source for monochrome image formation 21*bk*.

The smaller the optical output of the light source for monochrome image formation 21*bk* at the time of full-color image formation is set to become as compared with the optical outputs of the light sources for color image formation 21*y*, 21*m* and 21*c*, the more the wear of the light source for monochrome image formation 21*bk* is suppressed, and the more remarkably an effect of the extension of the length of life can be obtained. However, in a case where a value of the optical output is set to become too low, at the time of, for example, development of a negative, photoreceptor potential does not fall enough even if light is outputted and exposure is executed, so that the density of an image decreases, and a printed image may be scratched. Therefore, the optical output of the light source for monochrome image formation 21*bk* at the time of full-color image formation is set within a range of the optical outputs of the light sources for color image formation 21*y*, 21*m* and 21*c* or less and such an optical output or more that does not cause scratch of a printed image. In the example illustrated in Table 1, the lower limit value to which the value of the optical output of the light source for monochrome image formation 21*bk* can be decreased is around 0.25 mW.

Further, as mentioned before, in the full-color image forming apparatus 1, the monochrome image forming photoreceptor 11*bk* is formed so that the perimeter thereof becomes longer than the perimeters of the color image forming photoreceptors 11*y*, 11*m* and 11*c*. That is to say, the monochrome image forming photoreceptor 11*bk* is formed so that a length of life thereof becomes longer than those of the color image forming photoreceptors 11*y*, 11*m* and 11*c*.

In the full-color image forming apparatus 1, when the control portion 43 determines that the image to be formed based on the image information processed by the image processing portion 42 is a monochrome image, based on the determination, the control portion 43 controls the operations so that the optical output of the light source for monochrome image formation 21*bk* becomes a predetermined value and the process speed of the process driving portion 46 becomes faster than the process speed at the time of full-color image formation. An example of set values of the optical output of the light source for monochrome image formation 21*bk* and the process speed at the time of monochrome image formation are illustrated in Table 2. In the case of monochrome image formation, it is common that a large amount of images are formed at one time and, for example, such a number of images as in quick printing may be formed. Therefore, in the full-color image forming apparatus 1 of the present embodiment, the process speed at the time of monochrome image formation is set to become faster than the process speed at the time of full-color image formation, whereby increase of the efficiency of monochrome image formation is realized.

TABLE 2

| | |
|---|---|
| Process speed (circumferential velocity of monochrome photoreceptor | 355 mm/sec |
| Optical output of light source for monochrome image formation | 0.34 ± 0.03 mW |

In the full-color image forming apparatus 1, the monochrome image forming photoreceptor 11*bk* having a long perimeter and a long length of life is used, and the extended part of the length of life of the light source for monochrome image formation 21*bk* is applied to monochrome image formation, whereby monochrome image formation is executed at a high processing speed. In the setting of the process speed and the optical output of the example illustrated in Table 2, a monochrome image formation processing capability is about 70 sheets per minute in the case of A4 size paper prescribed by JIS-P0138.

Thus, the length of life of the light source for monochrome image formation 21*bk* is extended and the monochrome image forming photoreceptor 11*bk* is formed so that the length of life thereof becomes longer. Therefore, although the frequency and amount of monochrome image formation are more than those of full-color image formation, the light source for monochrome image formation 21*bk* and the monochrome image forming photoreceptor 11*bk* as monochrome image forming members, and the light sources for color image formation 21*y*, 21*m* and 21*c* and the color image forming photoreceptors 11*y*, 11*m* and 11*c* as color image forming members can end the lives thereof at the same time as the image forming portion 2 of the full-color image forming apparatus 1. In the case of operating in the setting examples as described above, the full-color image forming apparatus 1 of the present embodiment can last long enough to form about 500,000 sheets of monochrome images and form about 100,000 sheets of full-color images.

An image forming operation in the full-color image forming apparatus 1 will be briefly described below. The image information created by the external device 41 is inputted to the image processing portion 42 of the full-color image forming apparatus 1, and subjected to image processing in the image processing portion 42. The image information subjected to image processing is inputted to the control portion 43, and the control portion 43 determines whether the image information is a full-color image or a monochrome image.

When the image information is a full-color image, the control portion 43 outputs an operation command to the process driving portion 46 and the respective light sources 21 so that the process speed becomes slower than that at the time of monochrome image formation and the optical output of the light source for monochrome image formation 21*bk* becomes equal to or less than the optical outputs of the light sources for color image formation 21*y*, 21*m* and 21*c*, preferably, become less than the optical outputs of the light sources for color image formation 21*y*, 21*m* and 21*c*. In the image forming portion 2, the chargers 12 charges the surfaces of the photoreceptors 11 to uniform potential, the exposing portions 13 expose in accordance with the image information to form electrostatic latent images, and the developing portions 14 develop the electrostatic latent images, whereby toner images are formed. The toner images of the respective colors formed on the surfaces of the respective photoreceptors 11 are transferred on the transfer belt 25 one on top of the other, thereby becoming a full-color image.

On the other hand, when the image information is a monochrome image, the control portion 43 outputs an operation command to the process driving portion 46 and the respective light sources 21 so that the process speed becomes faster than that at the time of full-color image formation, and so that the optical output of the light source for monochrome image formation 21*bk* becomes a predetermined value, and so that the light sources for color image formation 21*y*, 21*m* and 21*c* do not output lights. In the image forming portion 2, the charger 12*bk* charges the surface of the monochrome image forming photoreceptor 11*bk* to uniform potential, the exposing portion 13*bk* exposes in accordance with the monochrome image information to form an electrostatic latent image, and the developing portion 14*bk* develops the electrostatic latent image, whereby a monochrome toner image is formed. The monochrome toner image formed on the surface of the monochrome image forming photoreceptor 11*bk* is transferred on the transfer belt 25.

The full-color toner image or the monochrome toner image transferred on the transfer belt 25 is transferred on a recording sheet picked up by the pickup roller 32 from the automatic sheet feeding portion 5, conveyed in the sheet conveying portion 7 and fed to the nip portion between the transfer belt driving roller 26 and the recording sheet transfer roller 30. The recording sheet on which the full-color toner image or the monochrome toner image is transferred is conveyed to the fixing portion 4, subjected to fixation in the fixing portion 4 to obtain a solid recording image, and discharged to the sheet discharge portion 8, whereby a series of image forming operations end.

The technology may be embodied in other specific forms without departing from the spirit or essential characteristics thereof. The present embodiments are therefore to be considered in all respects as illustrative and not restrictive, the scope of the technology being indicated by the appended claims rather than by the foregoing description and all changes which come within the meaning and the range of equivalency of the claims are therefore intended to be embraced therein.

What is claimed is:

1. A full-color image forming apparatus comprising:

a light source for monochrome image formation for exposing a monochrome image forming photoreceptor to light outputted therefrom to correspond to monochrome image information; and a light source for color image formation for exposing a color image forming photoreceptor to light outputted therefrom to correspond to color image information, wherein a full-color image is formed by exposing the monochrome image forming photoreceptor with the light source for monochrome image formation and the color image forming photoreceptor with the light source for color image formation, wherein also a monochrome image is formed by exposing only the monochrome image forming photoreceptor with the light source for monochrome image formation, and wherein when a full color image is formed using lights outputted from the light source for monochrome image formation and the light source for color image formation, an optical power setting of the light source for monochrome image formation is set to less than an optical power setting of the light source for color image formation.

2. The full-color image forming apparatus of claim 1, further comprising:

determining means for determining whether an image to be formed is a full-color image or a monochrome image; and controlling means for, when the determining means determines that the image to be formed is a full-color image, controlling the power setting of the light source for monochrome image formation in accordance with the determination so that the optical power setting of the light source for monochrome image formation becomes less than the optical power setting of the light source for color image formation.

3. The full-color image forming apparatus of claim 1, wherein the monochrome image forming photoreceptor and the color image forming photoreceptor have cylindrical or columnar shapes, and a perimeter of the monochrome image forming photoreceptor is longer than a perimeter of the color image forming photoreceptor.

4. The full-color image forming apparatus of claim 1, wherein sensitivity of the monochrome image forming photoreceptor to light is higher than sensitivity of the color image forming photoreceptor to light.

5. The full-color image forming apparatus of claim 1, wherein the light source for monochrome image formation and the light source for color image formation are laser diodes.

6. The full-color image forming apparatus of claim 1, wherein the light source for monochrome image formation comprises a single light source.

7. The full-color image forming apparatus of claim 6, wherein the light source for color image formation comprises a plurality of light sources, each respective light source being used for exposing a different color image forming photoreceptor.

8. The full-color image forming apparatus of claim 7, wherein when a full color image is formed using lights outputted from the single light source for monochrome image formation and the plurality of light sources for color image formation, an optical power setting of the single light source for monochrome image formation is set to less than an optical power setting of each of the plurality of light sources for color image formation.

9. A full-color image forming apparatus, comprising:

a monochrome image formation device that includes a monochrome photoreceptor and a monochrome light source that exposes a monochrome image on the monochrome photoreceptor using monochrome image information; and a color image formation device that includes a color photoreceptor and a color light source that exposes a color image on the color photoreceptor using color image information, wherein a light sensitivity of the color photoreceptor is lower than a light sensitivity of the monochrome photoreceptor; wherein a full-color image is formed by exposing the monochrome photoreceptor with light from the monochrome light source and exposing the color photoreceptor with light from the color light source, and wherein when a full-color image is being formed, a power setting of the monochrome light source is set lower than a power setting of the color light source.

10. The full-color image forming apparatus of claim 9, wherein a light sensitive layer of the monochrome photoreceptor has a greater quantum efficiency than a light sensitive layer of the color photoreceptor.

11. The full-color image forming apparatus of claim 9, wherein a light sensitive layer of the monochrome photoreceptor has a greater density of a charge generating substance than a light sensitive layer of the color photoreceptor.

12. The full-color image forming apparatus of claim 9, wherein a thickness of a charge generating layer of a light sensitive layer of the monochrome photoreceptor is thinner than a corresponding charge generating layer of a light sensitive layer of the color photoreceptor.

13. The full-color image forming apparatus of claim 9, wherein the monochrome photoreceptor and the color photoreceptor are both photosensitive drums, and wherein a diameter of the monochrome photoreceptor is greater than a diameter of the color photoreceptor.

14. The full-color image forming apparatus of claim 9, wherein the color image formation device comprises a first color image formation device that includes a first color photoreceptor and a first color light source that exposes a first color image on the first color photoreceptor using first color image information, and further comprising:

a second color image formation device that includes a second color photoreceptor and a second color light source that exposes a second color image on the second color photoreceptor using second color image information; and a third color image formation device that includes a third color photoreceptor and a third color light source that exposes a third color image on the third color photoreceptor using third color image information, wherein a light sensitivity of the first, second and third color photoreceptors are all lower than the light sensitivity of the monochrome photoreceptor.

15. The full-color image forming apparatus of claim 14, wherein a full-color image is formed by exposing the monochrome photoreceptor with light from the monochrome light source and by exposing the first, second and third color photoreceptors with light from the first, second and third color light sources, respectively, and wherein when a full-color image is being formed, a power setting of the monochrome light source is set lower than power settings of each of the first, second and third color light sources.

* * * * *